US010117517B2

(12) United States Patent
Becker et al.

(10) Patent No.: US 10,117,517 B2
(45) Date of Patent: Nov. 6, 2018

(54) REMOVABLE BACK REST

(71) Applicant: Kaspar Wire Works, Inc., Shiner, TX (US)

(72) Inventors: Darryl J. Becker, Cost, TX (US); Mike Bishop, Nixon, TX (US)

(73) Assignee: Kaspar Wire Works, Inc., Shiner, TX (US)

( * ) Notice: Subject to any disclaimer, the term of this patent is extended or adjusted under 35 U.S.C. 154(b) by 133 days.

(21) Appl. No.: 15/192,740

(22) Filed: Jun. 24, 2016

(65) Prior Publication Data

US 2017/0105532 A1 Apr. 20, 2017

Related U.S. Application Data

(60) Provisional application No. 62/242,543, filed on Oct. 16, 2015.

(51) Int. Cl.
*A47C 7/42* (2006.01)
*F25D 3/08* (2006.01)

(52) U.S. Cl.
CPC . *A47C 7/42* (2013.01); *F25D 3/08* (2013.01)

(58) Field of Classification Search
CPC ..... A47C 7/42; F25D 3/08
See application file for complete search history.

(56) References Cited

U.S. PATENT DOCUMENTS 2,710,412 A * 6/1955 Bayer ..... A47C 1/023 5/59.1
D200,309 S * 2/1965 Sokolis ..... 297/188.08
D298,186 S * 10/1988 Brannon ..... D6/336
4,799,731 A * 1/1989 Brown ..... A47C 1/16 297/144
5,100,198 A * 3/1992 Baltzell ..... A47C 7/74 280/30
5,269,157 A 12/1993 Ciminelli et al.
6,497,424 B2 12/2002 Gartner et al.
6,616,234 B1 * 9/2003 King ..... A47C 1/023 297/383
6,993,931 B1 2/2006 Hamilton
7,604,290 B1 * 10/2009 Giordano ..... A47C 3/32 220/915.2
8,857,882 B2 * 10/2014 Daniels, Jr. ..... B25H 5/00 296/37.1
2004/0025531 A1 2/2004 Holloman-Hughes
2005/0274726 A1 * 12/2005 Boggs ..... A47C 1/14 220/592.03

OTHER PUBLICATIONS

Yeti Beverage Holder and Rod Holster for Cooler, Yeti Tundra & Roadie Owner's Manual, p. 8, downloaded from Yeti website as early as Oct. 7, 2015; http://yeticollers.com/pages/owners-manual/.

* cited by examiner

*Primary Examiner* — David R Dunn
*Assistant Examiner* — Tania Abraham
(74) *Attorney, Agent, or Firm* — Jackson Walker, L.L.P.

(57) ABSTRACT

A removable backrest is attached to a cooler in such a manner that does not interfere with the opening or closing of the lid nor does it interfere with the sealing mechanism of the cooler. The removable backrest inserts into existing slots positioned in the walls of certain commercially available coolers. The angle of the frame permits a user to sit on the complete lid of the cooler and lean against the backrest. While the backrest is in position, the lid may be opened or closed at the user's convenience.

15 Claims, 5 Drawing Sheets

REMOVABLE BACK REST

CROSS-REFERENCES TO RELATED APPLICATIONS

This application claims the benefit of U.S. Provisional Application Ser. No. 62/242,543 filed Oct. 16, 2015. The contents of this application is incorporated by reference herein.

STATEMENT REGARDING FEDERALLY SPONSORED RESEARCH OR DEVELOPMENT

Not applicable.

BACKGROUND OF THE INVENTION

1. Field of the Invention

The present invention relates to a portable cooler with a removable backrest for improved comfort.

2. Background of the Related Art

Portable coolers are utilized in a wide range of social activities including at parties, camping, hunting, and beach trips. Commonly, due to lack of seating options, many people sit on tops of the coolers. In other situations it is intended that coolers are used for seats. In either circumstance a cooler top is generally not very comfortable due to the lack of a backrest. Individuals cannot lean backwards which reduces the overall level of comfort and places added strain on a person's back.

Previous methods to create or attach a backrest to a cooler included attaching a seat with backrest to the lid, permanently molding a seat and backrest into the lid, or permanently mounting a foldable backrest to the cooler. The previous designs have significant drawbacks in that they are either: a) integral to the cooler itself which adds bulk and weight; or 2) are removable but restrict access to the interior of the cooler or prevent the cooler from sealing correctly. There remains a need for a removable backrest that is easy to use, inexpensive, capable of fitting existing coolers, and does not restrict access to the interior of the cooler.

SUMMARY OF THE INVENTION

The present invention is a removable backrest designed to fit on commercially available coolers without disrupting the cooler's seal. The removable backrest consists of a frame with an attachment base and a backrest. The attachment base consists of a pin mounted to a base plate. The base plate is similar in size to depressions within the cooler's side walls. The pin is similar in size to the slots disposed through the cooler's sidewalls. Once the base plate and pin are inserted into the depression and slot respectively, the cooler lid closes against the sidewalls without interruption to the cooler's seal. The frame extends from the base plate up from the cooler at a steep angle such that the horizontal portion of the frame is generally aligned the rear sidewall or portion of the cooler. The angle of the frame allows the cooler lid to open and close without restriction. The removable backrest may be removed from the cooler for increased portability.

DETAILED DESCRIPTION OF THE VARIOUS EMBODIMENTS

Figure 2:
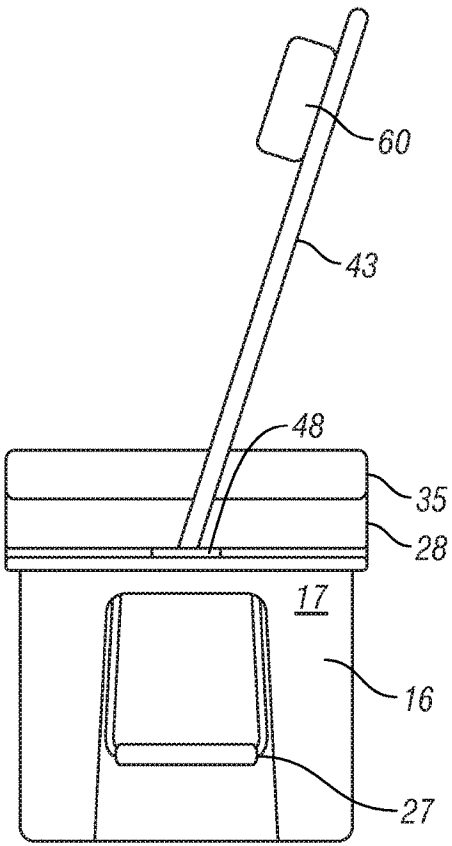
FIG. 2 is a profile of the right side of a cooler with the removable back rest.
Figure 1:
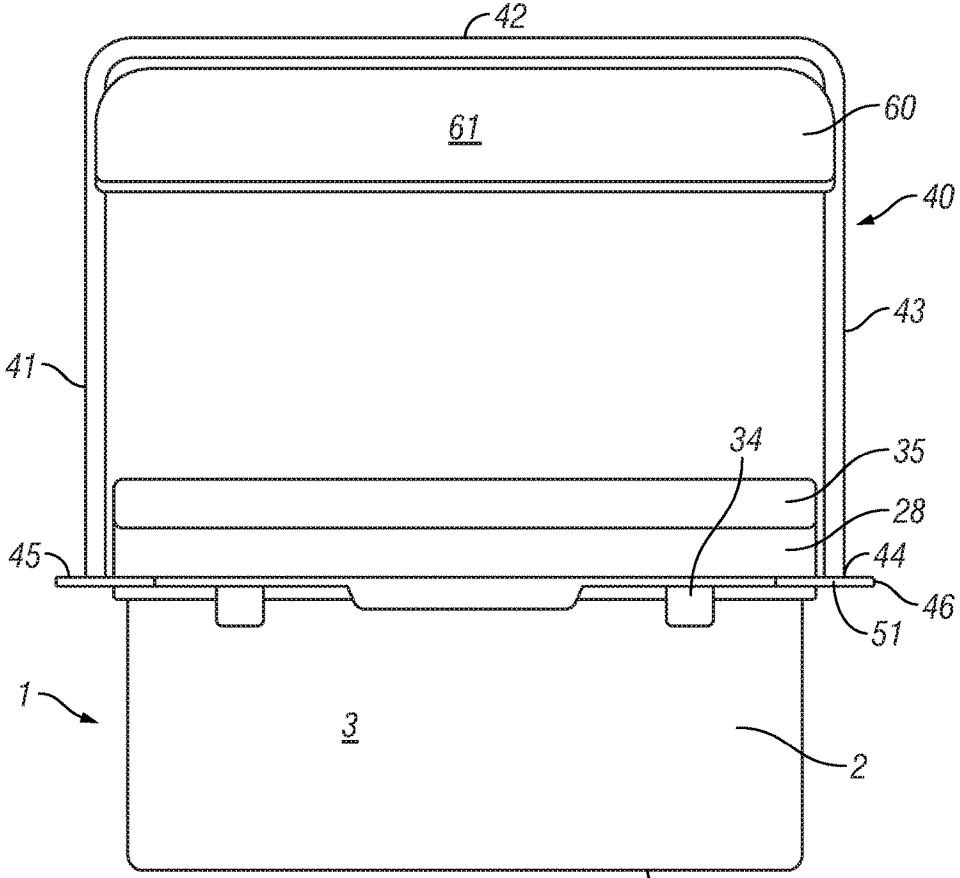
FIG. 1 is a profile of the front of a cooler with the removable back rest.
Figure 4:
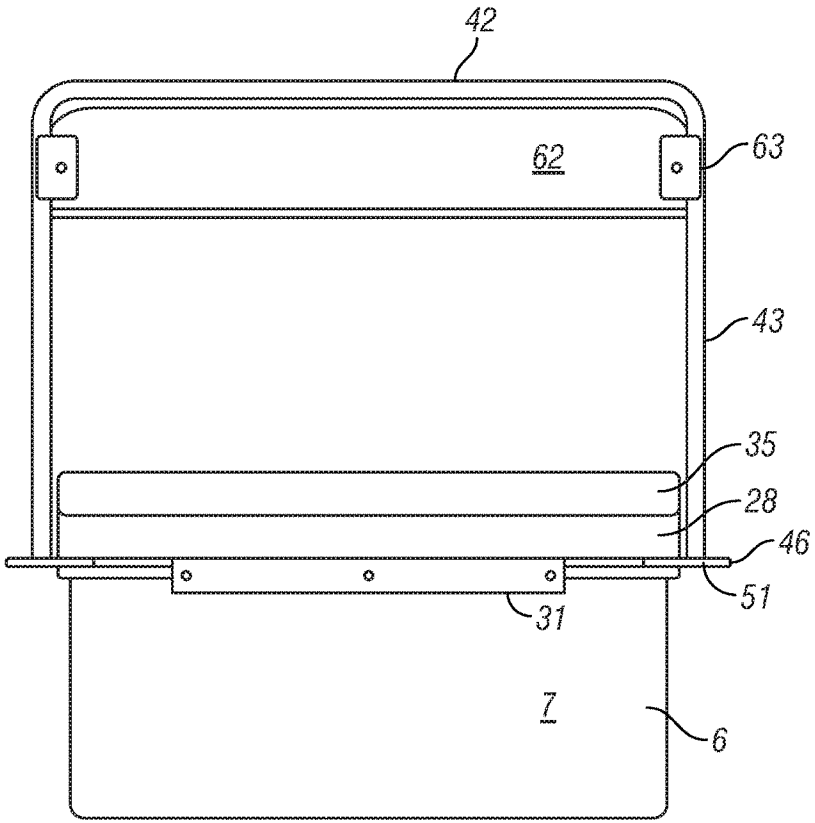
FIG. 4 is a rear view of a cooler with the removable back rest.

A standard cooler is disclosed in FIGS. 1-2, 4, 7-10. The cooler 1 is a generally rectangular shaped box having a front side wall 2 having an exterior 3, interior 4, and top face 5, a rear side wall 6 having an exterior 7, interior 8, and top face 9, a left side wall 10 having an exterior 11, interior 12, and top face 13, a right side wall 16 having an exterior 17, interior 18, and top face 19, and a bottom wall 22 having an exterior 23 and interior face 24. The side walls 2, 6, 10, 16 and bottom wall 22 define a cavity 25. Each of the walls 2, 6, 10, 16, 22 are constructed of an insulating material. A continuous ridged surface 25 rises from the top face 5, 9, 13, 19 of each side walls 2, 6, 10, 16. Positioned on the exterior face 11, 17 of the left and right side wall 10, 16 is a handle 27.

The left and right side walls 10, 16 have a shallow rectangular depression 14, 20 on the top face positioned approximately in the middle of each side wall between the front and rear side walls 1, 6. The shallow rectangular depression 14, 20 begins adjacent to the continuous ridged surface 25 and extends through the exterior face 11, 17 of the left and right side walls 10, 16. A slot 15, 21, parallel to the exterior face 11, 17, is positioned within the shallow rectangular depression 14, 20 proximal to the continuous ridged surface 25. Each slot 15, 21 extends into each side walls 10, 16 towards the bottom wall 22 approximately one fifth to one fourth down the height of the side wall 10, 16.

A lid 28, having an exterior face 29 and interior face 30, is mounted to the rear side wall 6 with a hinge 31. The hinge 31 permits the lid 28 to rotate towards the top faces 5, 9, 13, 19 of the side walls 2, 6, 10, 16 to close the cooler 1 or to rotate up to expose the cavity 25 of the cooler 1. The interior face 30 of the lid 28 contains a channel 32 that corresponds to the continuous ridge 26. A seal 33 is positioned at the nadir of the channel. When the lid 28 is closed the interior face 29 of the lid 28 abuts the top faces 5, 9, 13, 19 of the side walls 2, 6, 10, 16. In the closed configuration the continuous ridge 25 fits in the channel 32 and abuts the seal 33. This substantially encloses the cavity 26 to prevent air migration and to regulate temperature within the cavity 25. At least one latch 34 is attached to the lid 28 which connects to the exterior face 3 of the front side wall 2. The latch 34 secures the lid 28 in the closed position which results in the sealing of the cavity 26. A cushion 35 may be mounted to the exterior face 29 of the lid 28.

Figure 3:
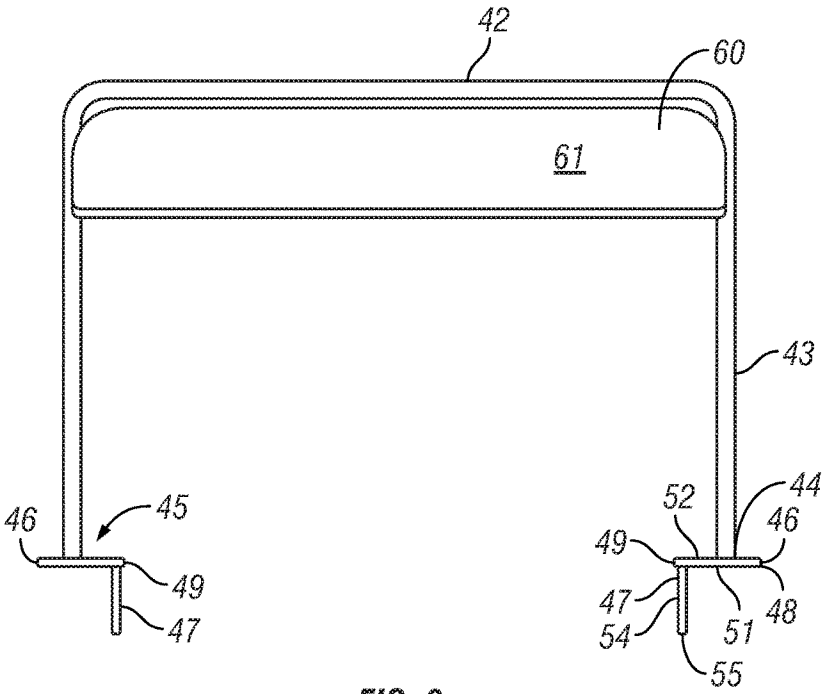
FIG. 3 is a front view of the removable back rest.
Figure 5:
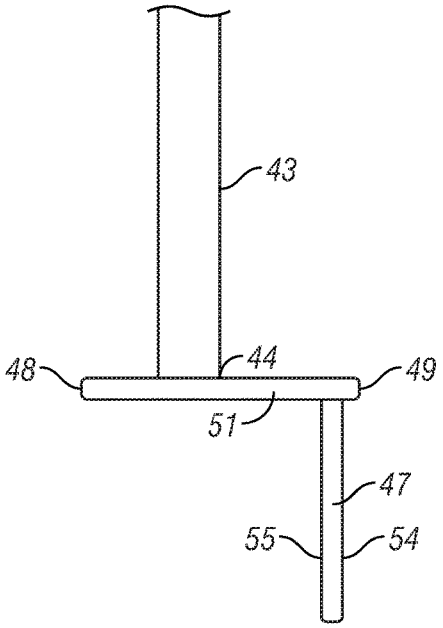
FIG. 5 is a close up view of the attachment base of the removable back rest.
Figure 6:
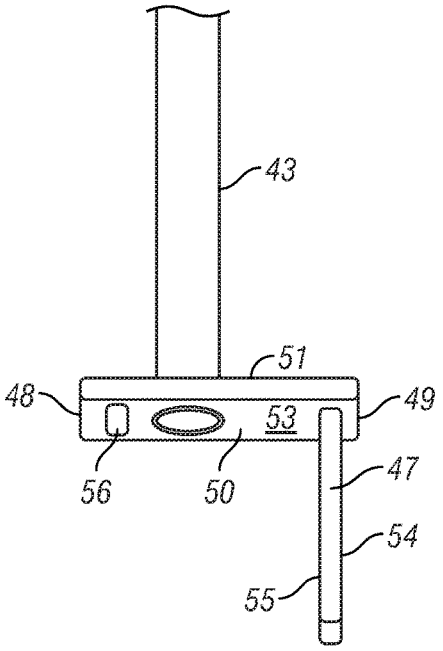
FIG. 6 is an angled view of the attachment base of the removable back rest.
Figure 7:
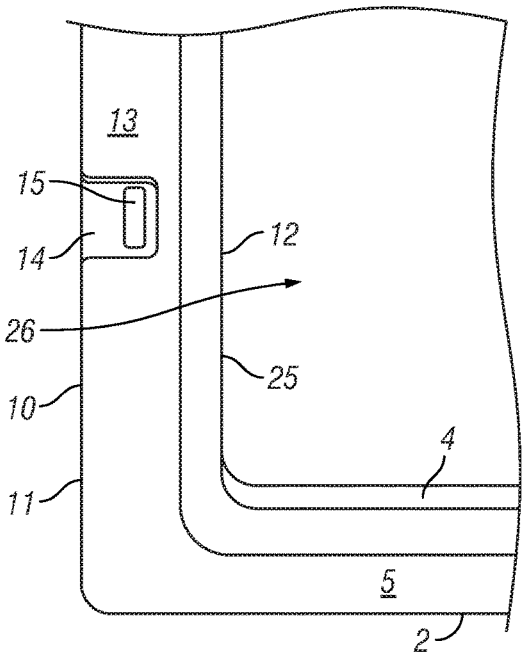
FIG. 7 is a close up view of the cooler with the lid open.

As seen in FIGS. 3, 5-6, the removable back rest 40 comprises a frame 41 and a backrest cushion 60. The frame 41 is generally U-shaped having a horizontal portion 42 and two opposing angled portions 43 with an attachment base 45. Each angled portion 43 is attached to the opposing ends of the horizontal portion 42. The backrest cushion 60, having a front face 61 and rear face 62, is attached to the horizontal portion 42 through mounts 63. The backrest cushion 60 may be constructed of a hard material or a cushion.

The attachment base 45 comprises a base plate 46 and a pin 47. The base plate 46 is rectangular in shape having first short side 48, second short side 49, first long side 50, second long side 51, a top face 52, and bottom face 53. The pin 47 is attached to the bottom face 53 of the base plate 46 adjacent the second short side 49. The pin 47 is generally rectangular in shape with an interior face 54 and exterior face 55. The pin 47 is positioned perpendicularly the base plate 46 with the width of the pin 47 aligned parallel to the first and second short sides 48, 49 of the base plate 46.

The terminal end 44 of the angled portion 43 attaches to the top face 52, proximal to the first short side 48 of the base plate 46. Base plate 46 has a slot 56 positioned between the first short side 48 and where the angled portion 44 attaches.

The angled portion 43 is not directly perpendicular to the base plate 46 but is instead mounted to the base plate 46 at a steep angle relative to the base plate 46. The angled portion 43 is mounted in such a manner that it angles toward the first long side 50 of the base plate 46 and away from the second long side 51. The base plate 46 is positioned in such a manner that the interior face 54 of each pin 47 is oriented towards the interior face 54 of the opposing pin 47.

Figure 8:
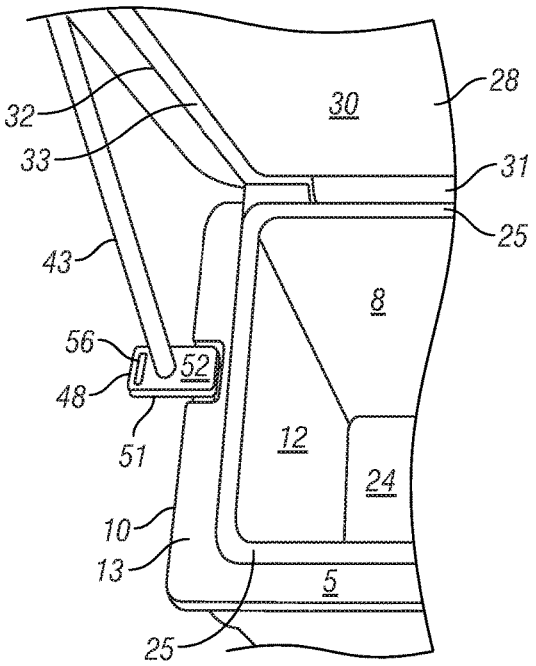
FIG. 8 is a close up view of the cooler with the removable back rest attached.
Figure 9:
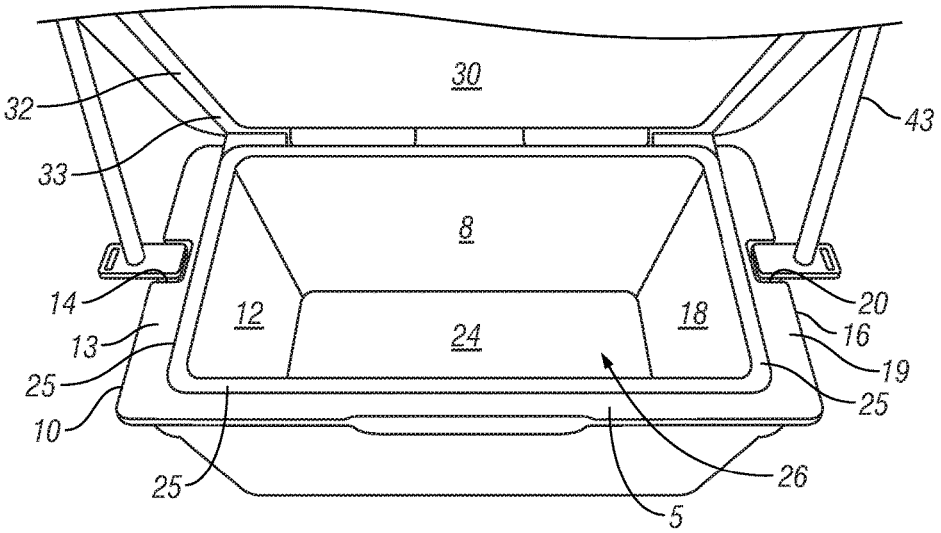
FIG. 9 is a view of the cooler with the removable back rest attached.

As seen in FIGS. 8-9, a portion of the base plate 46 beginning at the second short side 49, fits within the rectangular depressions 14, 20 with the pin 47 inserted into the slot 15, 21 of the left and right side walls 10, 16. The width and thickness of the pin 47 corresponds to the size of the slot 15, 21 such that the pin 47 securely fits within the slot 15, 21 but is removable. The width and thickness of the base plate 46 corresponds to the rectangular depression 14, 20 so as to not extend above the top face 13, 19 of the left and right side walls 10, 16. This is done to not inhibit or interfere with the closing of the lid 28 and the sealing created by the continuous ridge 25 positioned within the channel 32. The base plate 46 is of sufficient length that where the angled portion 43 attaches to the base plate 46 is beyond the exterior face 11, 17 of the left and right side walls 10, 16. This is done to prevent the lid 28 from touching the angled portion 43 during opening or closing of the lid 28.

Once in position, the backrest cushion 60 is generally parallel with first and second long sides 50, 51 of the base plate 46 and the front and rear side walls 2, 6. The front face 61 of the backrest cushion 60 is oriented toward the front side wall 2 and the rear face 62 is oriented towards the rear side wall 6. The backrest cushion 60 is generally aligned with the rear side wall 6. The horizontal portion 42 of the backrest is longer than the length of the rear side wall 6 of the cooler 1. The length and degree of angle of the angled portion 43 varies depending on the size of the cooler 1 and the desired height of the backrest cushion 60 in relation to the exterior face 29 of the lid 28 or cushion 35.

Figure 10:
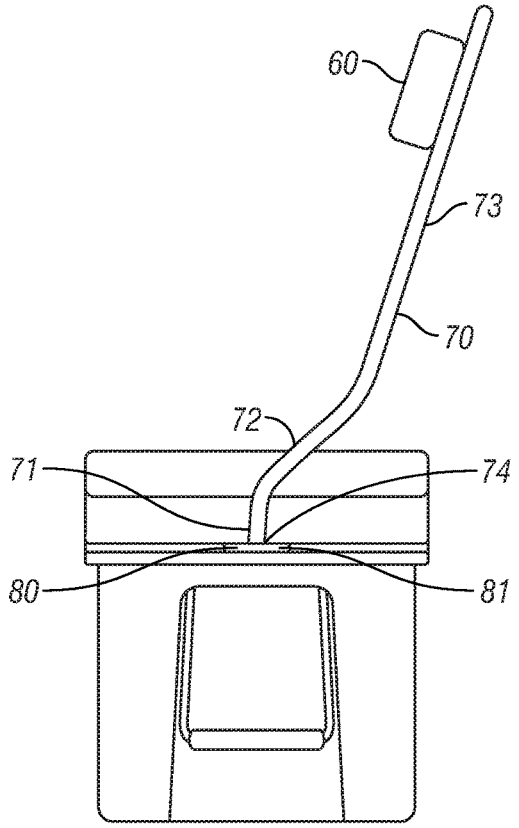
FIG. 10 is a view of an alternative embodiment of the removable back rest.
Figure 11:
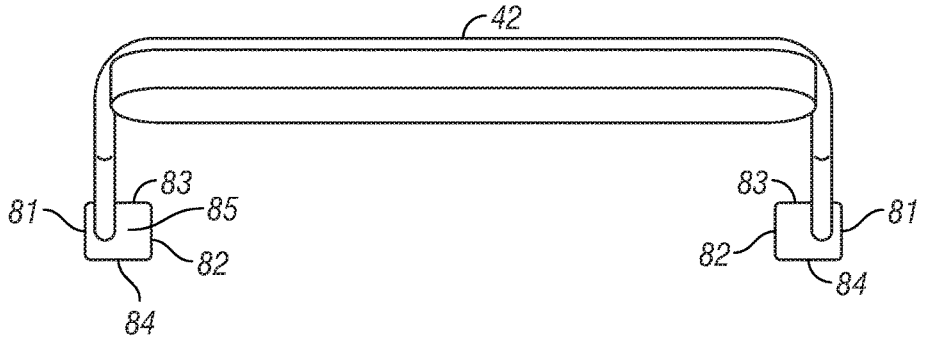
FIG. 11 is an angled top down view of an alternative embodiment of the removable back rest.

FIGS. 10 and 11 show another embodiment of the angled portion 70 and base plate 80. The base plate 80 is rectangular in shape having first short side 81, second short side 82, first long side 83, second long side 84, a top face 85, and bottom face. A pin extends from the bottom face of the base plate 80, proximal to the second short side 82. A portion of the base plate 80 beginning at the second short side 82, fits within the rectangular depressions 14, 20 with the pin inserted into the slot 15, 21 of the left and right side walls 10, 16. The width and thickness of the pin corresponds to the size of the slot 15, 21 such that the pin securely fits within the slot 15, 21 but is removable. The width and thickness of the base plate 80 corresponds to the rectangular depression 14, 20 so as to not extend above the top face 13, 19 of the left and right side walls 10, 16. The angled portion 70 is comprised of a vertical portion 71, a shallow angle portion 72, and a steep angle portion 73. The terminal end 74 of the angled portion 70 attaches to the top face 85, proximal to the first short side 81 of the base plate 80. When the lid 28 is closed and with the removable backrest in position, the vertical portion 71 extends perpendicularly from the base plate 80 and continues above the exterior face 29 of the lid 28 where it connects to the shallow angle portion 72. The length of the vertical portion 71 is approximately equal to the depth of the lid 29. The shallow angle portion 72 extends from the vertical portion 71 at a shallow angle relative to the base plate 80. The shallow angle portion 72 extends away from the lid 28 in the direction of the first long side 83. The steep angle portion 73 connects to the shallow angle section 72 and continues along the same direction as the shallow angle portion 72 but at a steeper angle relative to the base plate 80. The steep angle portion connects to the horizontal portion 42. The length and angle of the shallow angle portion 72 and steep angle portion 73 are dependent on the length and width of the cooler 1 as well as the desired height of the backrest cushion 60 as discussed supra.

The frame 41 may be constructed of a singular tube formed to correspond to the relative sections described above or each portion may be individually constructed and attached through fastening means including but not limited to welding, screws, or bolts. Furthermore, the frame may be constructed of non-static length material through the use of interlocking telescoping tubes to adjust the length of the horizontal portion.

The removable backrest is placed in position with the cooler lid 28 open. Both angled portions are positioned to insert the pin 47 into the slot 15, 21 and base plate 46 within the rectangular depression 14, 20 such that the backrest 60 is generally parallel with the rear side wall 6. The lid 28 is then closed. Because the size of the base plate 46 is specifically designed to fit within the rectangular depressions 14, 20, the continuous ridge 26 fits within the channel 32 and abuts the seal 33. Once a person sits on the lid 28, the weight of the person prevents the removable backrest from coming out of the slots 15, 21 even as the person leans against the backrest. To remove the backrest, the lid 28 is lifted and the removable backrest is pulled from the cooler. The design of the removable backrest allows for the lid 28 to open and close normally as if the removable backrest was not attached.

The present disclosure is described above in terms of a preferred illustrative embodiment of a removable back rest. Those skilled in the art will recognize that alternative constructions of such an apparatus can be used in carrying out the present invention. Other aspects, features, and advantages of the present invention may be obtained from a study of this disclosure and the drawings, along with the appended claims.

We claim:

1. A removable backrest for a cooler comprising a frame having a horizontal portion and two opposing side portions connected to said horizontal portion;

an attachment base connected to each said opposing side portions; and a backrest connected to the horizontal portion;

wherein said opposing side portions further comprise a vertical portion, shallow angle portion, and a steep angle portion wherein said shallow angle portion is disposed between said vertical portion and steep angle portion and said vertical portion is connected to said attachment base.

2. The removable backrest for a cooler as disclosed in claim 1 wherein said opposing side portions are mounted to the attachment base at a steep angle relative to the attachment base.

3. The removable backrest for a cooler as disclosed in claim 1 wherein said attachment base comprises a base plate and a pin wherein said opposing side portion is connected to the top of said base plate and said pin is connected to the bottom of said base plate on the opposite said as said opposing side portion.

4. The removable backrest for a cooler as disclosed in claim 3 wherein a slot is positioned through said base plate.

5. The removable backrest for a cooler as disclosed in claim 1 wherein said horizontal portion is adjustable.

6. A cooler with a removable backrest comprising a cooler having a bottom wall, at least one sidewall having a top face that define a cavity with two opposing slots disposed through said top face of said at least one sidewall, and a lid having a closed configuration and open configuration wherein said lid covers said top face of said at least one sidewall in said closed configuration; and a removable backrest comprising a frame having a horizontal portion and two opposing side portions connected to said horizontal portion;

an attachment base connected to each said opposing side portions; and a backrest connected to said horizontal portion;

wherein said attachment base is removably positioned within said opposing slots.

7. The cooler with a removable backrest as disclosed in claim 6 wherein said opposing side portions are mounted to the attachment base at a steep angle relative to the attachment base.

8. The cooler with a removable backrest as disclosed in claim 6 wherein said cooler further comprises a depression within said top face of said at least one sidewall wherein said opposing slot is positioned.

9. The cooler with a removable backrest as disclosed in claim 8 wherein said attachment base comprises a base plate and a pin wherein said opposing side portion is connected to the top of said base plate and said pin is connected to the bottom of said base plate on the opposite said as said opposing side portion.

10. The cooler with a removable backrest as disclosed in claim 9 wherein the thickness of said base plate is equal or less than the depth of said depression.

11. The cooler with a removable backrest as disclosed in claim 10 wherein said opposing side portions are mounted to the base plate at a steep angle relative to the attachment base.

12. The cooler with a removable backrest as disclosed in claim 9 wherein the width and depth of said pin is equal or less than the width and depth of said opposing slot.

13. The cooler with a removable backrest as disclosed in claim 6 wherein said opposing side portions is further comprise a vertical portion, shallow angle portion, and a steep angle portion wherein said shallow angle portion is disposed between said vertical portion and steep angle portion and said vertical portion is connected to said attachment base.

14. The cooler with a removable backrest as disclosed in claim 13 wherein said removable backrest does not obstruct the opening or closing of said lid.

15. The cooler with a removable backrest as disclosed in claim 6 wherein said horizontal portion is adjustable.

* * * * *